US005503701A

United States Patent [19]

Seick et al.

[11] Patent Number: 5,503,701

[45] Date of Patent: Apr. 2, 1996

[54] METHOD FOR PROVIDING RECYCLABLE STEEL DRUM FOR HOT FLOW PRODUCTS

[75] Inventors: Thomas Seick, Hoffman Estates, Ill.; Rex E. Wagers, Kingsport, Tenn.

[73] Assignee: Greif Bros. Corporation, Delaware, Ohio

[21] Appl. No.: 230,057

[22] Filed: Apr. 20, 1994

Related U.S. Application Data

[62] Division of Ser. No. 29,184, Mar. 10, 1993.

[51] Int. Cl.[6] ..... B29C 63/34

[52] U.S. Cl. ..... 156/247; 156/289; 156/294; 222/326

[58] Field of Search ..... 156/289, 294, 156/69, 91, 247, 293; 220/403, 404, 460, 461, 453, 462; 222/146.5, 326

[56] References Cited

U.S. PATENT DOCUMENTS

| | | | |
|---|---|---|---|
| 1,591,373 | 7/1926 | Griffiths . | |
| 1,944,042 | 1/1934 | Thompson | 220/403 |
| 1,969,120 | 8/1934 | Coakley . | |
| 2,082,760 | 6/1937 | Berni | 220/461 |
| 2,721,674 | 10/1955 | Lazard . | |
| 2,752,074 | 6/1956 | Martin | 222/326 |
| 2,861,714 | 11/1958 | Glossop . | |
| 3,220,602 | 11/1965 | Ficker . | |
| 3,357,626 | 12/1967 | Carpenter et al. | 220/461 |
| 3,377,766 | 4/1968 | Nelson | 156/294 |
| 3,412,903 | 11/1968 | Van Riper et al. | 222/326 |
| 3,443,735 | 5/1969 | Meijers | 220/404 |
| 3,545,643 | 12/1970 | Higgins | 220/461 |
| 3,629,092 | 12/1971 | George . | |
| 3,648,881 | 3/1972 | Rogers . | |
| 3,946,871 | 3/1976 | Sturm . | |
| 4,347,948 | 9/1982 | Hamada et al. | 220/404 |
| 4,526,290 | 7/1985 | Cerny . | |
| 4,595,119 | 6/1986 | Cho . | |
| 4,658,989 | 4/1987 | Bonerb | 220/403 |
| 4,666,041 | 5/1987 | Gordon . | |
| 4,702,390 | 10/1987 | Rinkovsky, Sr. . | |
| 4,949,872 | 8/1990 | Heaps | 220/462 |
| 5,098,751 | 3/1992 | Tamura et al. . | |
| 5,137,206 | 8/1992 | Hale | 220/460 |
| 5,232,117 | 8/1993 | Hale | 220/461 |

FOREIGN PATENT DOCUMENTS

| | | | |
|---|---|---|---|
| 902597 | 12/1953 | Germany | 220/462 |
| 2814414 | 10/1979 | Germany . | |
| 457520 | 11/1936 | United Kingdom | 220/461 |
| 726687 | 3/1955 | United Kingdom | 220/461 |

*Primary Examiner*—Steven D. Maki
*Attorney, Agent, or Firm*—Kane, Dalsimer, Sullivan, Kurucz, Levy, Eisele and Richard

[57] ABSTRACT

A metal drum and the method of making the same having a detachable lining removable therefrom after a first use to allow for the reuse or recycling of the drum.

6 Claims, 4 Drawing Sheets

METHOD FOR PROVIDING RECYCLABLE STEEL DRUM FOR HOT FLOW PRODUCTS

This is a divisional of copending application Ser. No. 08/029,184 filed on Mar. 3, 1993.

The subject matter of this application is related to the subject matter commonly assigned of U.S. application Ser. No. 07/867,821 filed on Apr. 13, 1993, now U.S. Pat. No. 5,232,117.

BACKGROUND OF THE INVENTION

1. Field of Invention

This invention relates to a drum used for transporting goods, and more particularly to a steel drum with a removable liner for containing material including liquid or semi-liquid materials which is reusable and/or recyclable.

2. Description of Prior Art

Cylindrical containers such as steel drums have been used for a long time as a means of storing or transporting a variety of materials including powdery or granular solids, or liquids and semi-liquids. These containers are built to withstand the exigencies of transit. The materials stored in them are removed by first removing the top of the containers and then pouring or pumping the materials out.

Drums are sometimes used to store so-called semi-liquid materials such as adhesives, lubricants, hazardous material or other material that would contaminate or leave contaminants on the interior surface thereof. This may involve materials which are basically meltable plastics which may be poured therein. These materials solidify upon cooling. To remove the material one uses a machine with a plunger, which is heated and equipped with an "0" ring type of seal. After removing the top cover, and disc seal, the drum is ready for emptying the contents. As the plunger is pushed downwardly into the drum, the heater melts and liquifies the materials and as the plunger moves downwardly, the material is pumped out through the plunger and put into the manufacturing process.

When the plunger gets toward the bottom of the drum, there remains a small amount of material which cannot be pumped out but is left in the bottom of the container after the plunger heating system has been removed. Such drums are normally used once and then discarded since the interior has become contaminated with the material it contained. Disposal and even recycling of such drums because of this is difficult. It has become desirable to provide drums however that may be reused or subject to recycling.

Moreover, steel drums are typically made of a heavy gauge metal and are relatively expensive. In view of the shipped material contaminating the interior surface of the drum, reuse is not possible, recycling is difficult and disposal may require special handling.

OBJECTIVES AND SUMMARY OF THE INVENTION

It is therefore an object of the invention to provide for a steel drum which is reusable and/or constructed such that it facilitates recycling.

A further objective is to provide a reusable drum adapted to hold and dispense semi-liquids such as hot melts which require special removal equipment.

Other objectives and advantages of the invention shall become apparent in the description of the invention.

The above objectives are attained by a metal drum having a sidewall steel shell open at both ends, a curl portion at each end. The drum is formed with a removable special liner. The liner comprises a fibre stock release-coated sheet which is adhesively positioned around the inside surface of the drum. Rings are placed on the top and bottom to hold covers in place. The drum can now be used to contain a wide variety of material. If after use the end user wishes to reuse the drum for a different product the top and bottom covers are removed. It is now possible to lift out the liner which may be disposed of and the liner replaced and rings added. The covers which may be similarly lined with a removable portion which is stripped therefrom and replaced with the covers reattached. The drum could now be used to contain other material. The liner on the drum sidewall has an upper edge disposed in a circumferential groove formed below the drum top to insure that the liner remains intact while the drum is emptied.

BRIEF DESCRIPTION OF THE DRAWINGS

Thus by the present invention, its objects and advantages will be realized, the description of which should be taken in conjunction with the drawings wherein.

DETAILED DESCRIPTION OF THE PREFERRED EMBODIMENT

Turning now more particularly to the drawings, there is shown a drum 10 which comprises a cylindrical shell 12 made out of metal such as heavy gauge steel. The drum 10 includes two detachable covers 14 and 16 which are affixed to the shell 12 by way of locking rings 18, 20.

Figure 1:
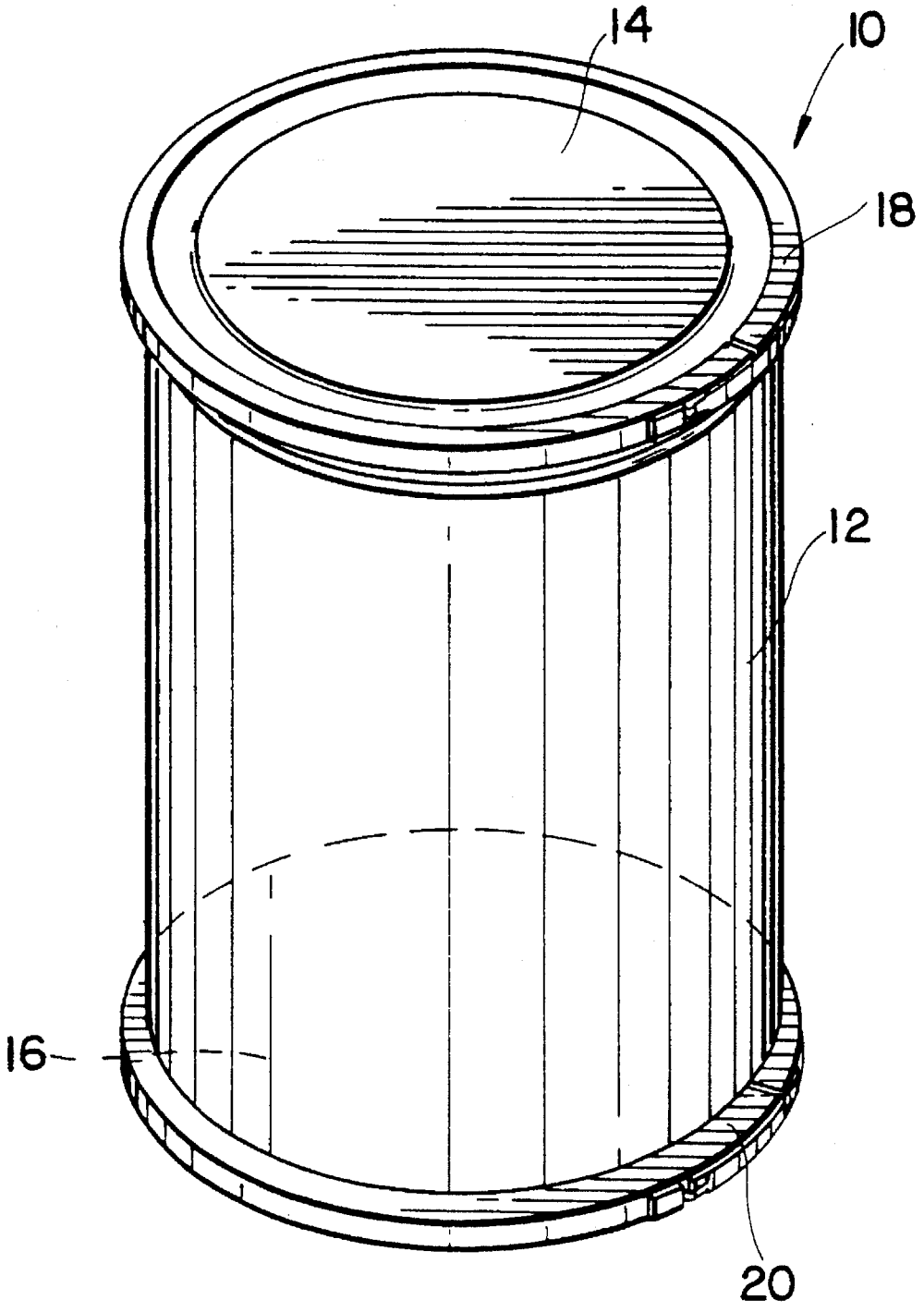
FIG. 1 is a perspective view of a reusable drum incorporating the teachings of the present invention.
Figure 2:
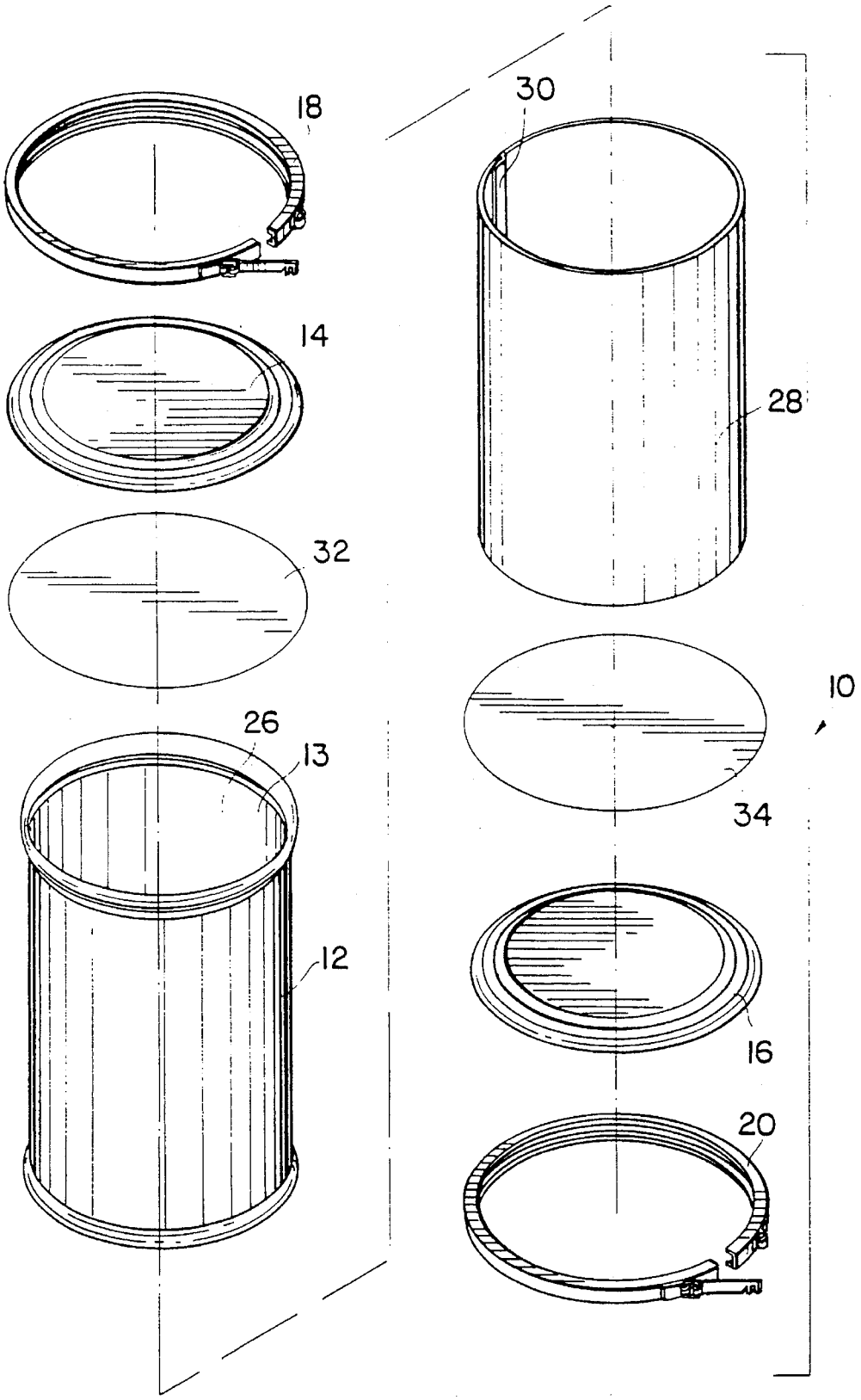
FIG. 2 shows an exploded view of the reusable drum of FIG. 1.
Figure 3:
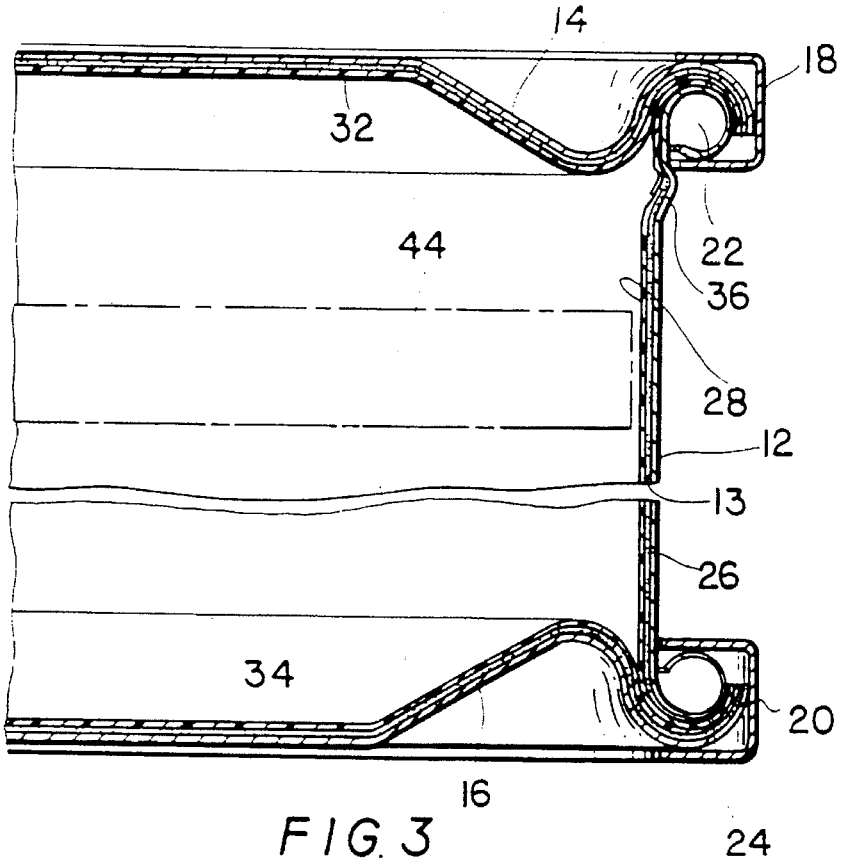
FIG. 3 shows an enlarged elevational sectional view of the drum.
Figure 4:
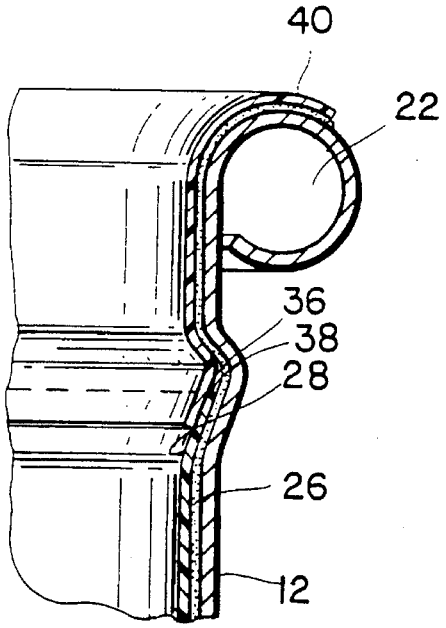
FIG. 4 shows a sectional view of the upper portion of the reusable drum of FIGS. 1–3.
Figure 5:
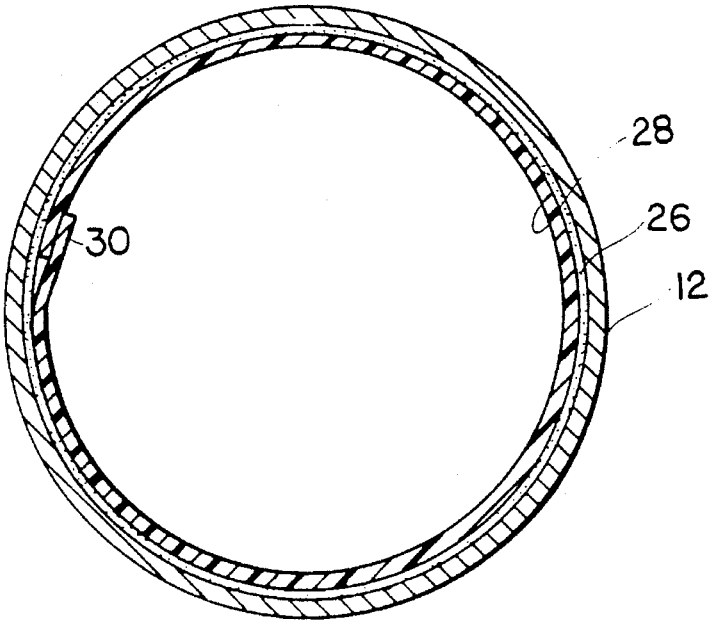
FIG. 5 shows a plan sectional view of the drum.
Figure 6:
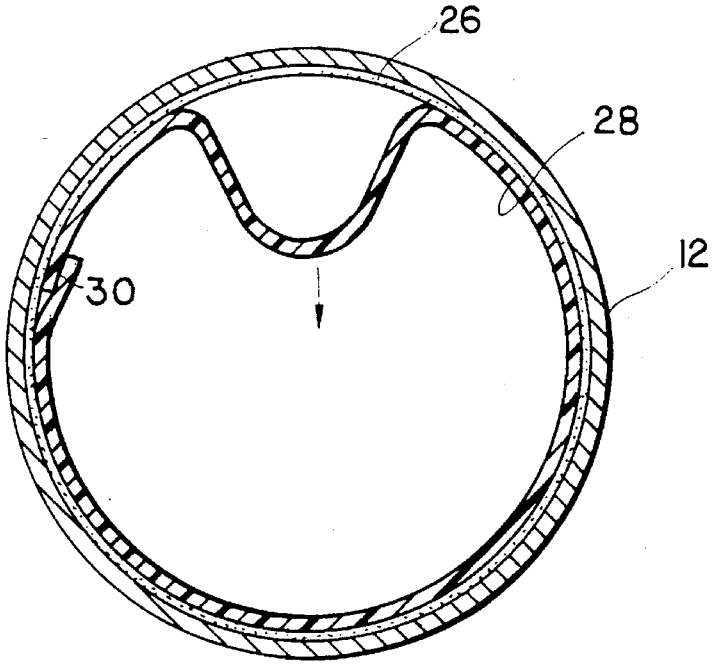
FIG. 6 shows a sectional view of the drum with the liner being removed.

The drum 10 illustrated may be used to contain a liquid or semi-liquid material which is extracted therefrom by way of a plunger device such as that illustrated in U.S. Pat. No. 3,412,903 to Van Riper Jr. The top and bottom of shell 12 terminate in a rolled edge or curl 22, 24 to which the respective covers are affixed as will be discussed. The inner surface 13 of the shell 12 is covered with layer 26 of pressure-sensitive adhesive about 3 mil thick. The covers 14 and 16 are similarly provided with an adhesive layer and a liner 32, 34 respectively. Disposed on the coated internal surface of shell 12 is a liner 28. Liners 28, 32, 34 may be made of release coated fibre such as silicone coated Kraft paper. The liner 28 should be impermeable to the material to be contained by the drum 10. The circumferential ends of the liner 28 are overlapped as at 30 (FIG. 5). The shell 12 is also provided with a circumferential groove 36 extending radially outwardly of inner surface 13. The top liner edge 38 of liner 28 is disposed in groove 36. A tape 40 is then placed circumferentially around curl 22 and extending downwardly into groove 36 to overlap and cover edge 38 as shown in FIG. 4.

Once the shell 12 and covers have been lined, the bottom cover 16 is affixed to shell 12 by locking ring 20. The drum is then filled with a material and the top cover 14 may be removably attached to the top of the shell 12 by way of a locking ring 18. Thus with the foregoing arrangement the entire interior surface of drum 10 is prevented from contacting the contained material.

To remove the material stored in drum 10, for example a hot flow-type material, the top cover 14 is first removed and hot melt head of a plunger 44 is inserted (shows by phantom lines). The drum 10 has a standard inner diameter so that the dispensing head 44 can easily fit into the drum. Importantly, because the liner edge 38 is disposed in groove 36, it is protected from the head. At the same time, since with the outwardly extending groove 36, the inner diameter of the drum is constant the plunger 44 is free to move up and down through the drum to selectively dispense its contents. As the plunger 44 advances downwardly into the drum, it does not rip the liner 28. Further protection for the liner 28 is provided by the tape 40 which insures that the liner edge 38 remains in groove 36. In addition, tape 40 also maintains the top of the surface 13 and curl 22 above liner 28 free of the material under the drum. After the plunger 44 reaches the bottom, it is withdrawn. The bottom cover 16 is now removed to gain access to the residue in the drum.

Once the drum 10 is depleted of its material, to reuse the drum the following steps are taken. The top and bottom covers 14 and 16 are removed and the liners 32, 34 are discarded and replaced with fresh liners. The tape 40 and liner 28 is also removed and disposed of. The shell interior is now fresh and uncontaminated. A new liner can then be placed in the interior of the drum and secured by a new tape.

Obviously, numerous modifications may be made to the invention without departing from its scope as defined in the attached claims.

We claim:

1. A method comprising the steps of:

providing a metal cylindrical shell having a cylindrical sidewall, a top and bottom open end and an interior surface between said open ends, said surface having an outwardly extending circumferential groove adjacent said top end;

adhering a liner having an edge on said interior surface of said shell, the step of adhering includes the steps of disposing the edge of said liner within said groove and extending said liner from said groove to said bottom end, said liner being impermeable to said material;

placing a detachable lined metal cover at said bottom end;

filling said shell with material;

placing a detachable lined metal cover at said top end to form a drum filled with said material wherein the drum has a constant inner diameter so that a plunger is free to more up and down through the drum;

removing the detachable cover from said top end;

removing material from said drum using said plunger; and replacing the liner with a new liner.

2. The method of claim 1 further including the step of forming said liner out of silicone coated fibre.

3. The method of claim 1 further comprising the step of applying tape circumferentially around the top end prior to the step of placing the detachable cover at the top end, the step of applying includes extending the tape downwardly into the groove to overlap and cover the top edge of the liner.

4. The method of claim 1 further comprising the step of affixing the detachable covers to the top and bottom ends with locking rings.

5. The method of claim 1 wherein the liner includes overlapping longitudinal ends.

6. The method of claim 1 further comprising the step of providing release coating on said liner for releasing said liner from the interior surface of said shell.

* * * * *